United States Patent [19]

Taylor

[11] 4,248,280

[45] Feb. 3, 1981

[54] METHOD AND MACHINE STRUCTURE FOR FINGER JOINTING OF LUMBER

[76] Inventor: Keith A. Taylor, P.O. Box 626, Whitefish, Mont. 59937

[21] Appl. No.: 967,277

[22] Filed: Dec. 7, 1978

[51] Int. Cl.[3] ..... B27F 1/16

[52] U.S. Cl. ..... 144/3 R; 118/DIG. 9; 118/35; 118/59; 144/91; 144/198 R; 144/309 L; 144/314 B; 156/258; 156/304.5; 156/557

[58] Field of Search ..... 156/258, 517, 304, 578; 144/2 R, 1 R, 3 R, 85, 89, 90 R, 90 A, 91, 198, 199, 200, 314 R, 314 B, 315 R, 326 R, 309 L, 327, 328, 201, 218; 118/DIG. 9, 35, 59, 242

[56] References Cited

U.S. PATENT DOCUMENTS

| | | | |
|---|---|---|---|
| 2,770,272 | 11/1956 | Morrison | 144/317 |
| 3,126,308 | 4/1964 | Brockerman et al. | 144/317 X |
| 3,179,135 | 4/1965 | Windsor | 144/91 |
| 3,262,723 | 7/1966 | Strickler | 144/309 L |
| 3,527,274 | 9/1970 | Kramer et al. | 144/91 |
| 3,602,275 | 8/1971 | Nissen | 144/91 X |
| 3,802,986 | 4/1974 | Forsythe | 156/258 |
| 3,844,320 | 10/1974 | Dimter | 144/91 X |
| 4,128,119 | 12/1978 | Maier | 156/304 X |
| 4,130,150 | 12/1978 | Cook et al. | 144/91 |

*Primary Examiner*—W. Donald Bray
*Attorney, Agent, or Firm*—Cole, Jensen & Puntigam

[57] ABSTRACT

Method and means, including a trim saw structure, for assembling finger jointing lumber by an impression finger joining process wherein the ends of two pieces of lumber are placed in spaced apart position and held securely by clamps. A movable section of the machine trims and shapes the ends of the lumber into fingers which are then engaged by a hot die for further impression forming and heating of the fingers. The die moves out of position and a movable applicator applies glue to the outer half of the matching ends of the lumber. The ends are then pressed together and the joined pieces of lumber are advanced away from the work station. The process is a continuous such that incoming random lengths of lumber are joined to form a continuous outgoing length of lumber for cutting into desired lengths. One or more lines of lumber may be advanced through the finger jointing work station during a machine cycle.

21 Claims, 26 Drawing Figures

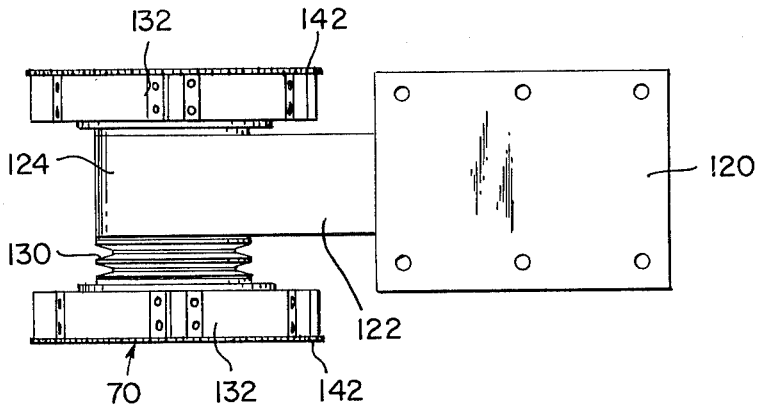
FIG. 14
FIG. 15
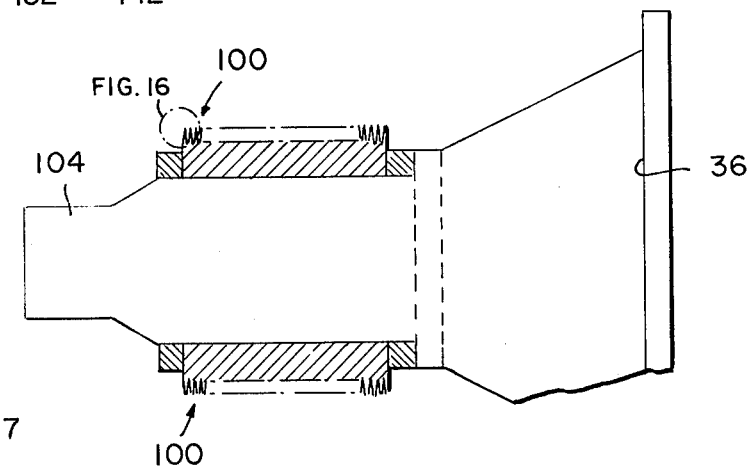
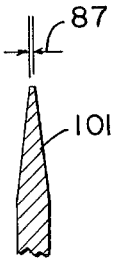
FIG. 16
FIG. 18
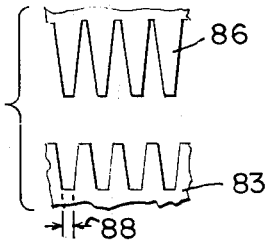
FIG. 17
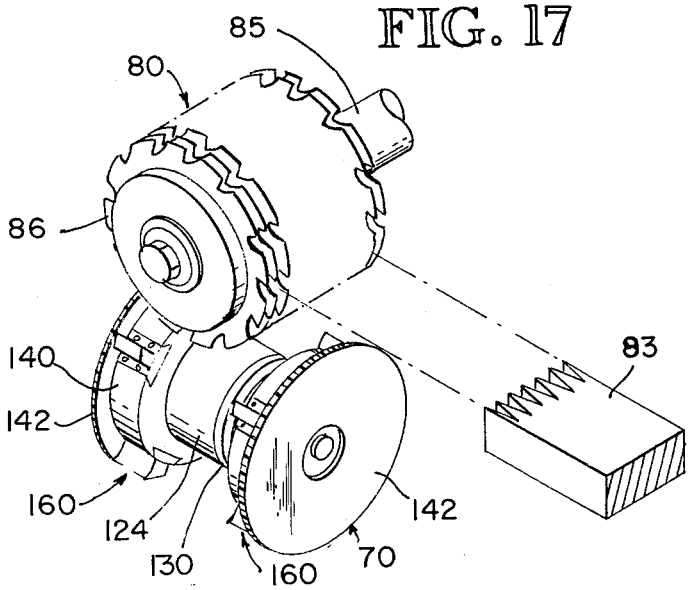
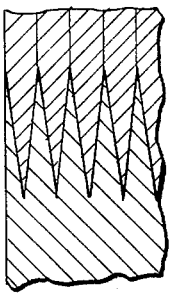
FIG. 19

METHOD AND MACHINE STRUCTURE FOR FINGER JOINTING OF LUMBER

BACKGROUND OF THE INVENTION

This invention relates to a method and means for finger joining random lengths of lumber, and more particularly to a method and machine structure for the continuous forming of vertical or horizontal impression type finger joints for lumber and for oriented or parallel grained plywood, referred to by the industry as "P.L.V."

Those skilled in the art are aware that horizontal finger joints can be made much more rapidly than vertical joints, due to a continuous forward motion which is accomplished with transfer chains, versus a stop and go operation-commonly used in the vertical finger joint system. However, this same transfer procedure is less reliable in producing uniform joints as opposed to the stop go system.

In a stop-go system, two pices of material are rigidly held by vise cages until the joint is completed and semi-cured. No misalignments can occur as is possible with transfer chains by which work pieces are indexed at various points for different operations. In addition, with the horizontal process, if a joint is misaligned when crowded through a radio frequency tunnel, pressure will occur unevenly in fingers and movement in the joint will also occur while curing. When moving along a tunnel the joints may become twisted which in turn may open part of the joint. Partial opening results in loss of pressure and weakens the glue line. The movement involved in transferring the lumber through the tunnel, unless it is held absolutely straight, weakens the glue line. In some cases, the glue line could fail completely. This results in marginal joints.

It is a well-known fact that pressure is required on the wood glue line in order to obtain a good structural bond. Neither the vertical or horizontal process can lay claim to a consistantly good glue bond on the outside fingers, but because of the configuration of a vertical joint, the loss of bondage on the outside fingers has less effect on the strength of the joint. With the horizontal finger joint process, an oversized piece can be joined and then resurfaced to eliminate the poorly bonded outside finger or outer fingers can be trimmed back to eliminate flare.

The common machined finger joint, be it vertical or horizontal, has flats at both the crest and root of the finger. This flat tip area takes up a sizable percentage of cross-section in the joint but contributes little or nothing to the strength of the joint. With the impression-type finger joint system, a fine pitch joint is used to hold the cross-section of the outside fingers to an absolute minimum. This fine pitch along with the knife-edged vertical finger tips are among the facts which make the impression-type joint superior to the more common, machined horizontal or vertical joint.

In summation, it is known that the efficiency of a joint is attributable to: Tensil strength of the material; alignment of the joint while it is being made and cured; joint preparation reliability that has the right length fingers and precise profile to give the proper glue line pressure; glue bond usually considered in terms of percent of wood failure; and percent of cross-section that has proper slope and pressure on the glue line.

The prior art lack of joint reliability is due to numerous factors, but primary reasons are misalignment and profile defects due to moisture content variations such as for instance, the differences in wood densities between spring and summer growth. A significant reason for this is the lack of a machine which could cycle form a joint quickly and yet achieve a strong joint as the random lengths of lumber proceed through the joint forming work station or stations. Additionally, prior art shaper saws have been large and for that reason require more than one arbor of shaper saws. The result of the double arbor of blades contributed to off tolerances in preshaped teeth. Other defects were to be found in the manner of applying adhesive to the joints which resulted in inconsistent application of the glue. It is difficult to join wet and dry lumber in radio frequency curing as the current is greater in the wet piece and thus can damage the glue line. In some cases, the glue itself has been of the wrong type. Reduced to readily understandable terms, the industry problems in finger joining of lumber come down to lack of machine speed, lack of simplicity in the operation thereof and lack of consistency in joint quality. The net result has been expensive finger jointed lumber with joints which are in important structural respects simply inadequate. Thus there has been recognized a need for a single cycled operation at one forming station at a speed which would make it commercially feasible to produce finger jointed lumber with consistently strong, reliable and durable joints.

Among the prior art references of interest are the following U.S. Pat. Nos.: 3,262,723; 3,942,233; 3,951,189; 3,985,169; 3,927,705 and 4,041,998.

SUMMARY OF THE INVENTION

A finger jointing machine and method involving routing one to four or more lines of random length lumber to a finger joint forming work station. The tail end of one length of lumber and the front end of another are advanced to the work station and clamped into position. A horizontal carriage bearing a dual trim saw and a finger preshaping saw are advanced outwardly from a vertically movable carriage which then begins a downward movement. Cutoff or trim saws trim the ends of the two pieces of lumber. After trimming, the vertical carriage continues downwardly and a tooth cutting shaper saw forms teeth of predetermined dimension in the ends of the board. The vertical carriage is continued downardly to a position to present a heated tooth die which engages the teeth formed in the board ends. The trim and shaper saws are retracted. Clamp cages then close and jam the lumber teeth against the die teeth. The clamp cages are then retracted to move the teeth off the die. A glue pot with rollers has been extended outwardly thus signalling the vertical carriage to move upwardly and the rollers apply the adhesive to the teeth of both pieces of lumber as the carriage moves upwardly. The clamp cages then jam the ends of the lumber against each other for a predetermined time thus completing the joints. The clamps of vise cages are released from the boards and then retracted and the joined lumber is moved forward to present the new ends in the work station position and the cycle is repeated.

Accordingly, it is among the many features, advantages, and objects of the instant invention to provide an impression type finger jointing machine and method which has a rapid cycling time and which therefore has an established high volume production capacity. One to four lines of lumber can be processed simultaneously at the joint forming work station. The joints made have superior structural strength and reliability. The method uses glue which continues to cure at room temperature even after the joints have left the work station. The method can be operated with a higher moisture content in the wood material, and in fact, can be used with green lumber. The method and machine of this invention require less power than that needed by other processes in which the curing is done in radio frequency tunnels. The machine requires substantially less floor space than is required by radio frequency cured finger jointing systems. Maintenance on shaper saws is less since the heater die puts finishing dimensions on the fingers. The system is less sensitive to moisture than a radio frequency type cure. The fingers have no appreciable flats at the crest or at the root thereof so the joints themselves possess a much higher mechanical efficiency in that a higher percentage of the glue line area in the fingers is on nearly parallel grains. The hot die swedging and wood fiber densifying together with the parallel grains, insure a stronger and more durable joint. The joints as they proceed out of the machine, even though further curing is taking place, will be at near full strength. Within fifteen minutes of forming, the joints will possess in excess of one times the working stress strength required in a finger jointed piece of lumber which has been kiln dried. The process results in joints with a higher modulus of rigidity. The shaper saw forming of the fingers is not as critical as other processes because of the heater die teeth. Because of the impression forming fibers of the teeth surfaces are oriented to be parallel and smooth the fingers present more ideal gluing surfaces to each other.

BRIEF DESCRIPTION OF DRAWINGS

FIG. 14 is a partial top plan view showing additional details of the mounting and construction of the trim saw;

FIG. 15 is a schematic representation of the hot teeth forming die with FIG. 16 being an enlargement to illustrate the shape of the forming die teeth;

FIG. 17 is a partial perspective view showing additional details of the relationship of the trim and preshape saw assemblies;

FIG. 18 is a view illustrating the shape of the fingers formed by the preshape saw; and FIG. 19 is a partial view showing an enlarged representation of two pieces of lumber joined together after they have been finally formed by the forming die.

DESCRIPTION OF PREFERRED EMBODIMENT

Figure 1:
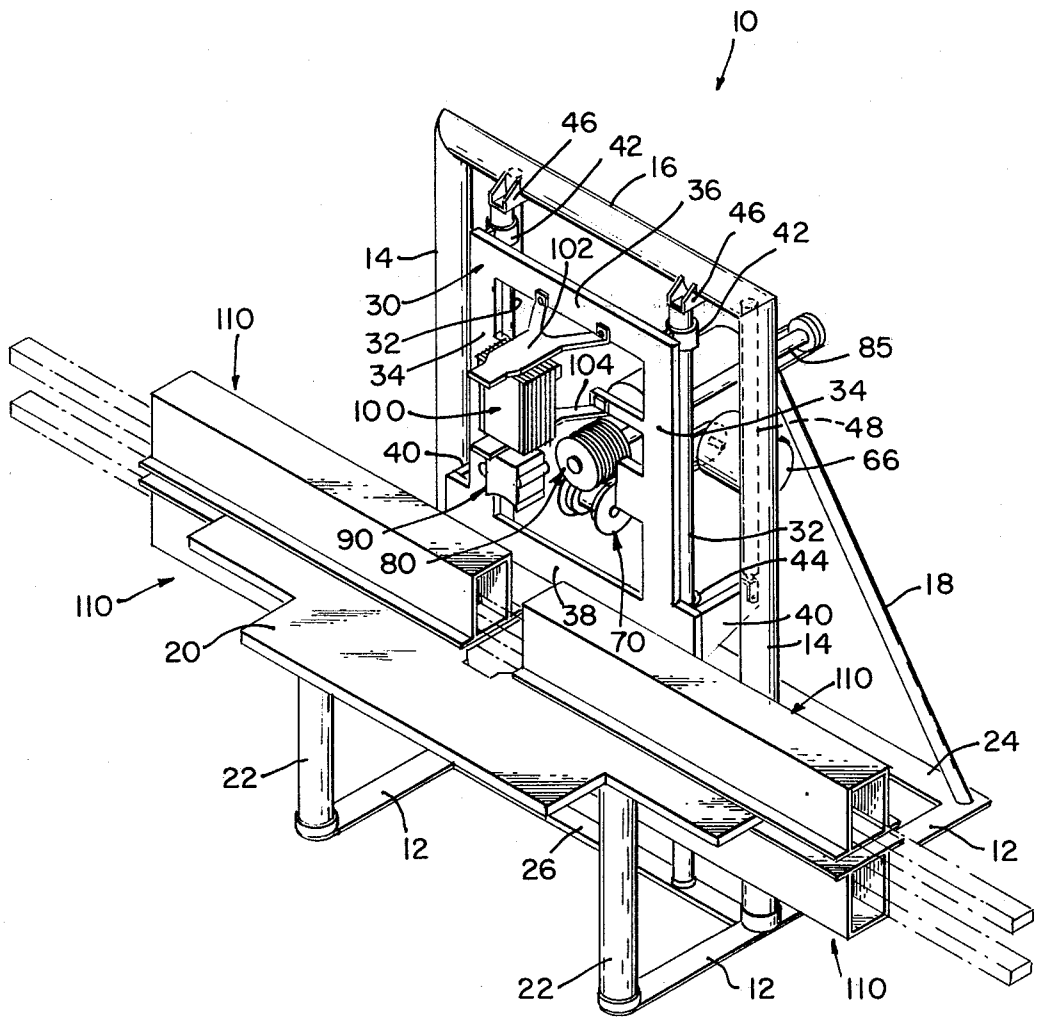
FIG. 1 shows a dual line machine of the instant invention in perspective.

Referring now to the drawings and in particular to FIGS. 1–3, and 11–17, it will be seen that the finger jointing machine, generally designated by the number 10, is comprised of a frame structure having a base 12, upstanding main spaced apart frame members 14 and main top cross member 16.

Diagonal frame members 18 extend generally from the top of upright members 14 to the rear of the base members 12 as is clearly shown in the drawings. Additionally, a front section includes a table surface 20 supported by table support frame members 22 which as can also be seen are secured to the base frame members 12. Cross frame members 24 and intermediate cross space member 26 are also provided to add rigidity and strength to the basic frame assembly.

Within the rectangular space defined by the upstanding frame members 14 and the top cross member 16, is a vertically movable carrier frame generally identified by the number 30. Two upstanding carrier frame guide members 32 are supported within the main frame as shown. The carrier frame 30 has side vertical frame pieces 34, top frame piece 36, bottom frame piece 38, which member 38 at the outer ends thereof has rearwardly extending arms 40 which are outside the guide rods 32. On the rear side of the carrier frame 30 are frame mounting sleeves 42 located at the upper rear corners of the carrier frame and mounting sleeves 44 at the lower rear corners. On the underside of the top cross frame member 16 of the main frame are located top brackets 46 which extend rearwardly about the same distance are brackets 40 at the bottom on the carrier. A cylinder 48 interconnects the top brackets 46 attached to the main frame with the rearward end of the carrier arms 40 as can best be seen in FIG. 2. Thus the carrier frame 30 is moved up and down by extending and retracting cylinder 48.

Figure 2:
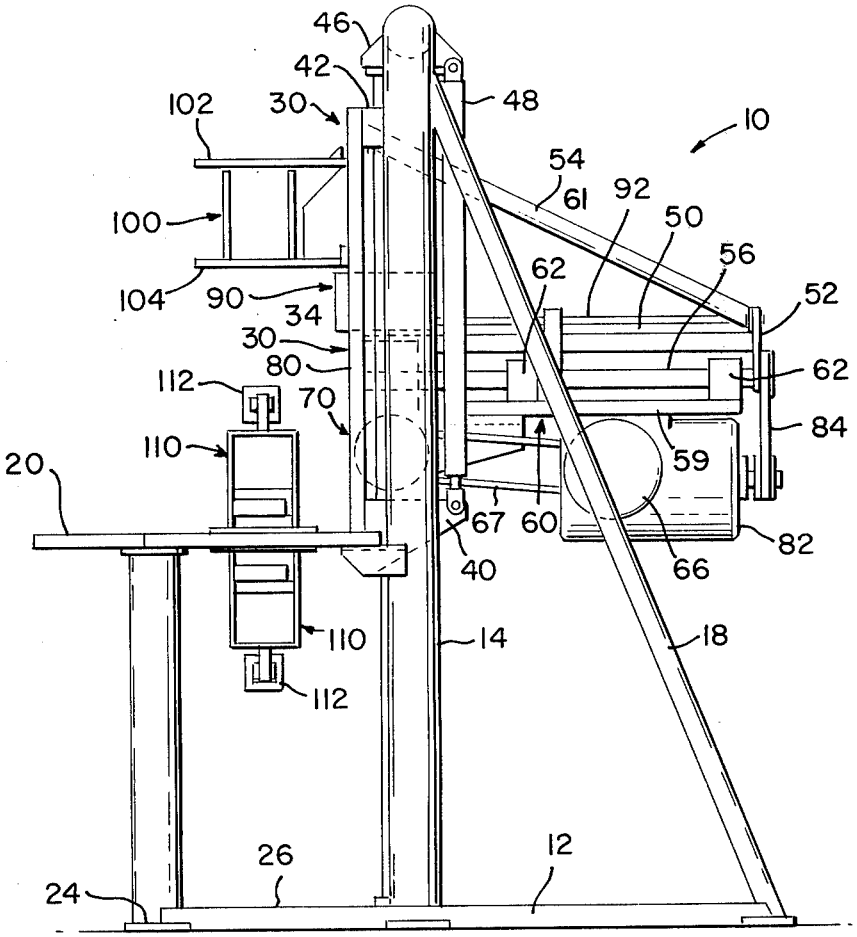
FIG. 2 is a side elevation view, somewhat simplified, to show details of construction and further illustrating the method of operation.
Figure 3:
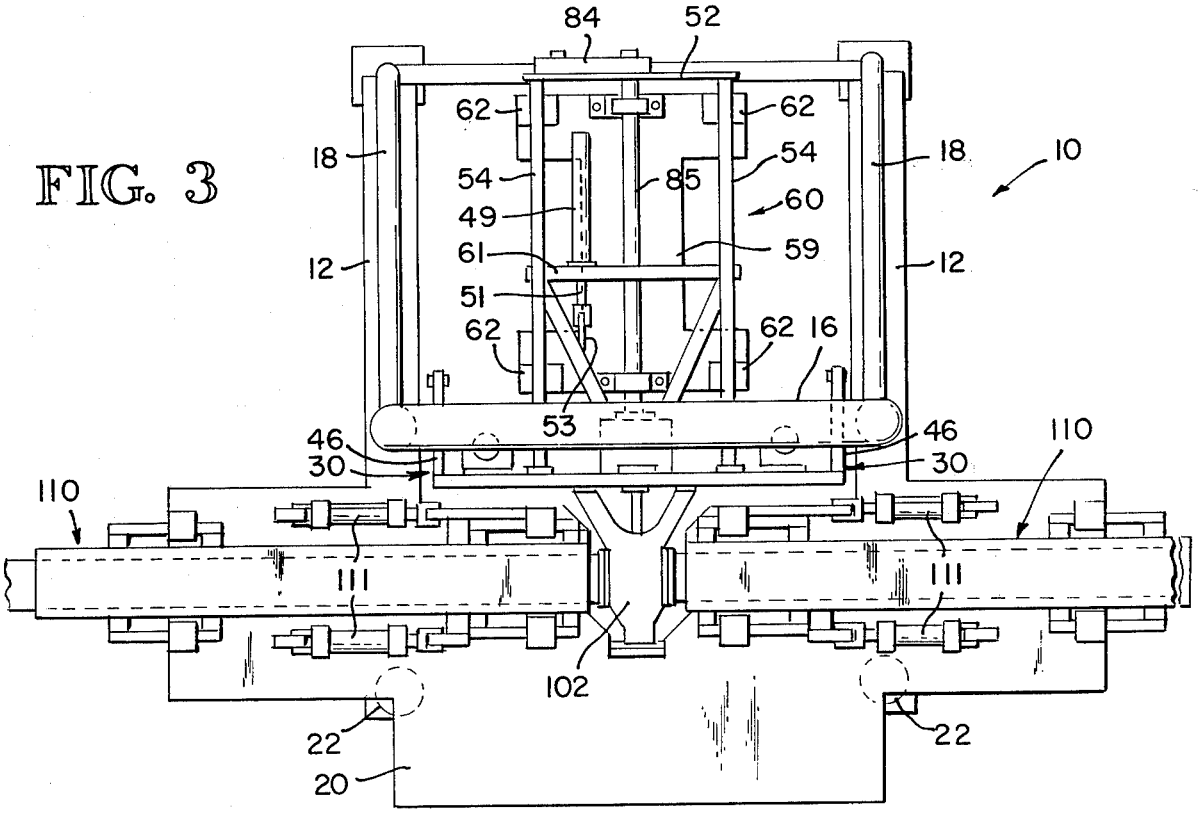
FIG. 3 is a top plan view of the machine to further illustrate details.

Extending to the rear of carrier frame 30 are rear support frame members 50 which are interconnected at the back end by connector frame piece 52. Strut members 54 extend diagonally from the top of the rear side of the carrier frame 30 rearwardly and at an angle downwardly to the rear cross frame piece 52 as can be seen in FIG. 2. A horizontal slide frame generally designated by the number 60 is slidably supported on rear support bars or rod members 56 of the carrier's rear support frame. Slide mounting bearings 62 allow the horizontal frame 60 to be slidably supported on the members 56. Cylinder means 49, having piston rod 51 attached to bracket 53 mounted on a main support plate 59, moves horizontal frame 60 forwardly and rearwardly in a manner which will be described hereinafter.

Supported on the horizontal slide frame 60 for movement inwardly and outwardly are a trim saw 70 and shaper saw 80. A glue pot 90 is mounted on separate slide bars on the frame 30, and motors 60 and 82 are mounted on slide frame 60. A heater die, generally designated by the number 100, is supported by upper and lower brackets 102 and 104 secured to the vertical carrier frame 30. Trim saw motor 66, through belts 67, drives the trim saw 70. The teeth shaper saw motor 82 through belts 84 drives the shaper saw shaft 85. Glue pot 90 is mounted on a pair of guide members 92 for in-and-out movement independently of the trim saw 70 and the shaper saw 80 as set forth above. Finally, it will be noted that vise cages generally designated by the number 110 together with clamping cylinders 112 are provided. Jam cylinders 111 located on the sides of the cages move the cages and clamped lumber toward each other so the fingered ends are jammed together. In this instance, there is one line of vise cages 110 on top and one line of vise cages 110 on the bottom of table 20. It will be noted that the inner end of the vise cages are spaced apart to define a work station space and an opening is provided in table 20 that as the finger jointing cycle proceeds the operating elements may pass through the work station.

FIGS. 11–17 are included to show additional details of the machine features. In FIGS. 11–17 details of the trim saw 70 are set forth. An anchoring plate 120 attaches to the horizontal slide frame 60 and to the plate 120 is secured a connector section 122 which engages or is secured to a trim saw support 124. A main mounting shaft 126 is supported by bearings 128 within the support 124. A pulley 130 is keyed to the shaft 126 and driven by belts 67 shown in FIGS. 2 and 11 from motor 66 as described above. A mounting spindle 132 is mounted at each end of the main shaft and secured in position by bolts 134 and retainer washers 136. The mounting spindles 132 are threaded at their outside diameters as at 138 to receive blade mounts 140 which thread onto the spindles 132. Blades 142 are mounted on the outer surfaces of the blades mounts 140 by a series of mounting screws 144. The threaded relationship between the blade mount 140 and mounting spindle 132 enables a precise positioning of the blades with respect to each other and with respect to the ends of the boards which will form a joint. Approximately six adjusment set screws 146 are provided around the inside periphery of mounting spindle 132 and extend through the spindle into an adjustment space 148 between the spindle and the blade mount. Thus as the blade mount 140 is turned for precise positioning of blades 142 the adjustment set screws 146 may then be tightened against the blade mount to hold it firmly in position for operation. Threads are formed to insure that mount 140 tightens against set screws 146 instead of loosening when saw torque is applied.

It is to be noted that the rotational axis of the trim saws passes inside the rectangle formed by the outside edges of the lumber pieces. This is necessary in order to use a small diameter saw blade for accuracy and control of joint quality. In other words, the axis of the trim saw and preshaper saw are at right angles to the machine but the longitudinal axis of the boards is set a slightly angle of about 2° or less to the machine. Thus where the teeth are formed they are off alignment with respect to the board axis by about half a pitch so that when moved together the crests of one board's teeth will slide onto the roots of the other. It will be appreciated by those skilled in the art that if the saw axis did not pass between the ends of the boards that a larger diameter saw with greater mass and weight, more movement, and less cycle speed would be necessary thus impairing accuracy.

Hog knives 160 are detachably anchored in the blade mounts 140 so that as the end of the boards are trimmed the ripper teeth will clear away any short piece of board which extends beyond the trim saw blade cut and which might otherwise interfere with the trim saw moving downwardly as it is performing its operation. Four equally spaced hog knives 160 in each of the blade mounts 140 are considered to be sufficient for the hogging function, although the number of knives 160 may vary.

FIG. 15 shows that the heated forming die 100 is a series of straight teeth 101 which are disposed vertically between brackets 102 and 104. At the outer dimension of teeth 101 between arrows 87 as seen in FIG. 16, the dimensions of the flat on the end is approximately 0.002 to 0.005 inches which forms practically a knife edge on the die teeth. The tapered portion of each tooth on the die is approximately 0.380 inches long.

The shaper saw 80 shown in FIGS. 17 and 18 has a series of horizontal stack of blades 86 mounted on the outer end of drive shaft 85. The teeth are approximately 0.020 inches thick at the outer end or flat between arrows 88 with a combined angle of taper of approximately 18°. The blades 86 shape fingers which are about 0.300 inches deep on the ends of the boards with a repeat spacing of approximately 0.106 inches. After the die teeth 101 have further impression formed the fingers on board 83, the fingers of the joint will resemble those shown in FIG. 19.

By referring to the diagramatic illustrations in FIGS. 4A–10B, a description of the process and machine operation may be followed sequentially through a cycle. In order to more clearly appreciate this series of figures, the A views illustrate a front elevational view looking at the machine from the front while the B series of views is a corresponding side view of the operational parts thus enabling the reader to understand the movement of the vertical carrier frame 30 and the horizontal frame 60 as a cycle proceeds.

Figure 4A:
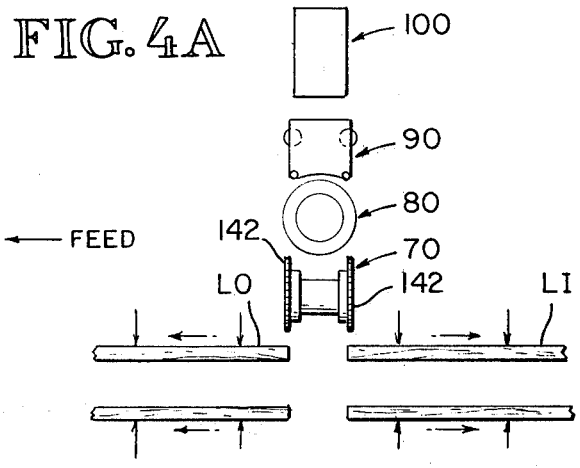
FIG. 4A–10B illustrate in schematic form the operational sequence of a cycle informing a joint.
Figure 4B:
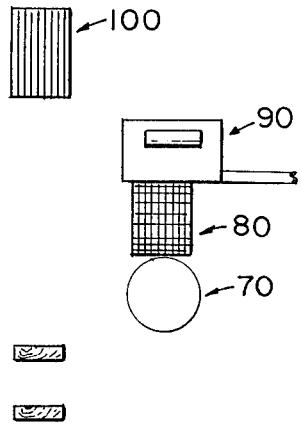

In FIGS. 4A and 4B, lumber pieces have advanced so that the outgoing piece of lumber LO has advanced to a position where its tail end is perhaps $\frac{1}{8}$ inch from clearing trim saw 142. In like manner, the leading end of the incoming piece of lumber LI has advanced approximately $\frac{1}{8}$ inch beyond or inside the cutting plane of the other trim saw blade. The vise cages which have a predetermined amount of horizontal movement inwardly towards the work station are at their outer position as shown by the horizontal arrows. The vise cages clamp onto the lumber pieces as indicated by the direction of the vertical arrows. The machine and the two pieces of lumber are now set for the beginning of an operational cycle.

Figure 5A:
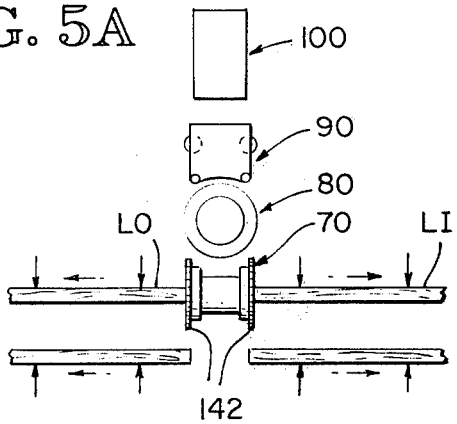
Figure 5B:
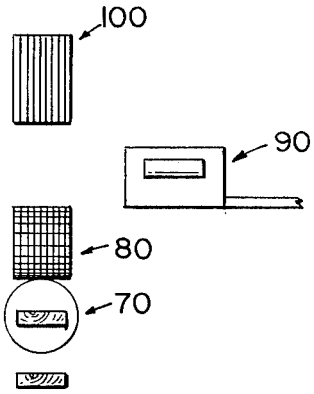

In FIGS. 5A and 5B, the carrier frame 30 has begun its downward movement with the trim saws 142 first engaging the lumber pieces LO and LI to precisely trim the ends as shown. The horizontal frame 60 moves out first to signal the carrier frame 30 to start down. Note that as the carrier frame 30 has begun its downward movement the trim saw 70 and shaper saw 80 have been advanced outwardly by the horizontal slide frame 60. It will be seen from the side on FIG. 5B that both the trim and shaper saws are in position to engage the board ends. The glue pot 90 remains retracted.

Figure 6A:
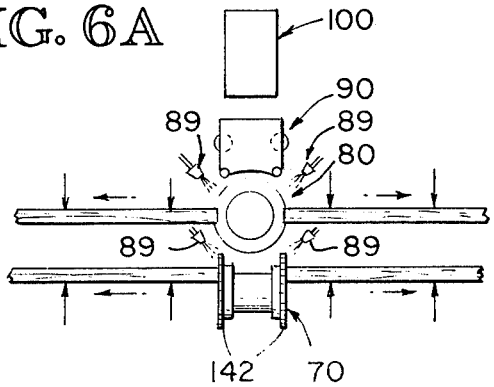
Figure 6B:
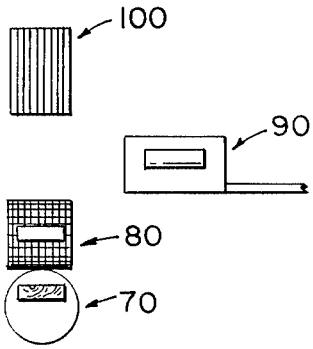

FIGS. 6A and 6B show that the trim saw has advanced downwardly with the movement of the frame 30 and that the rotational axis of the trim saw 70 passes within the edge planes and between the ends of the boards. As the trim saw is finishing off the lower line of lumber, the shaper saw has engaged the top or first line of lumber pieces to shape the teeth as shown in FIGS. 17 and 18. The glue pot 90 remains retracted as the carrier frame 30 proceeds downwardly. Water sprays 89 shown in FIG. 6A squirt a predetermined amount of water on the ends of the boards after the finger shaper saw 80 has made its pass through the ends of the boards.

Figure 7A:
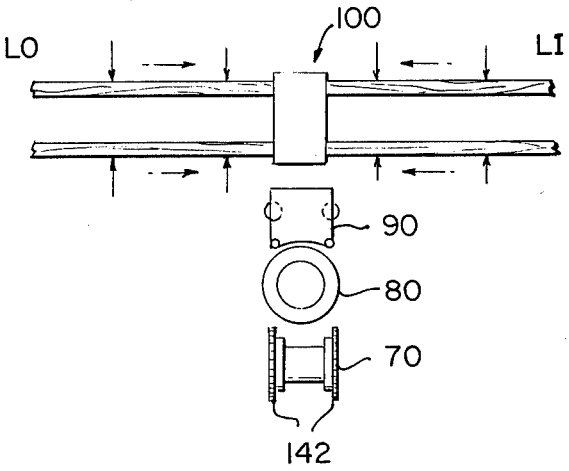
Figure 7B:
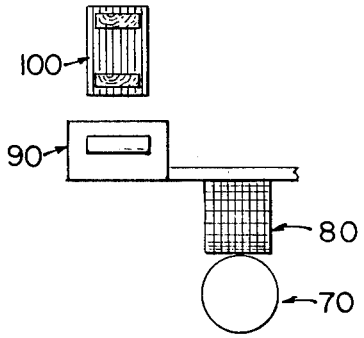

In FIGS. 7A and 7B the shaper and trim saws have completed their passes and have been withdrawn by the horizontal frame 60. The vertical carrier frame 30 has advanced downwardly to allow the heater die 100 and teeth 101 to be brought into a position to engage the finger shaped ends of the boards. As shown by the horizontal arrows, the vise cages 110 which are still holding the lumber clamped now move against the die to complete the impression forming of the teeth in the boards. As the vise cages jam the ends of the board against die 100 the trim and shaper saws 70 and 80 are being retracted. The board ends are jammed against die teeth 101 for a predetermined period of time.

Figure 8A:
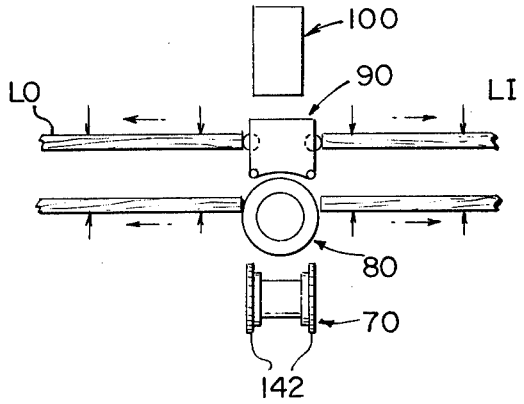
Figure 8B:
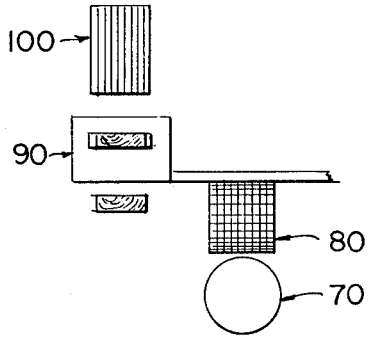

In FIGS. 8A and 8B the die forming and heating step, accomplished by pressing the ends of the board against the die teeth, has been completed and the vise cages as shown by the horizontal arrows have been retracted to release the die to allow upward movement. The glue pot 90 has moved to a full out position below the work station which triggers upward movement of carrier frame 30. As the carrier frame 30 moves upwardly the glue pot 90, which has already been extended outwardly, applies and engages the rollers on the sides of the glue pot to a depth of approximately half the length of the teeth on both board ends to apply the adhesive.

Figure 9A:
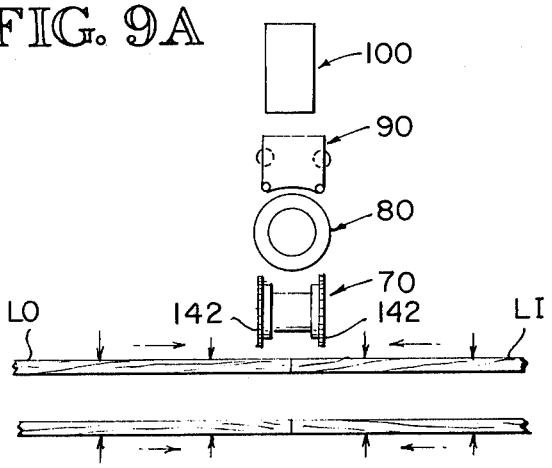
Figure 9B:
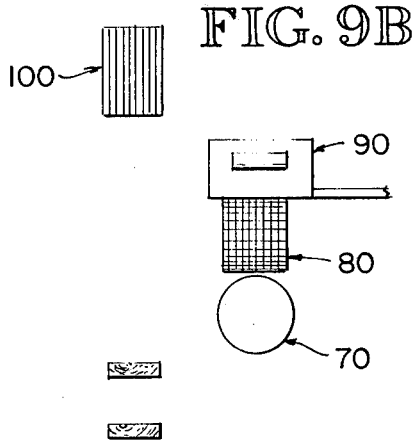

As shown in FIGS. 9A and 9B, the glue pot 90 has finished its upward motion to apply glue to the fingers and the pot has been retracted. As soon as the glue pot 90 has cleared, the vise cages, again shown by the horizontal arrows, move inwardly to jam the ends of the boards together to form the finger joint. The boards are held in the position shown in 9A for perhaps two seconds to allow some bonding to take place. Then the clamps, as shown by the vertical arrows, will release and the conveyor rollers will advance the lumber pieces with the newly formed joint away from the work station area. The cages once the boards are released, then retract away to get ready to cycle again.

Figure 10A:
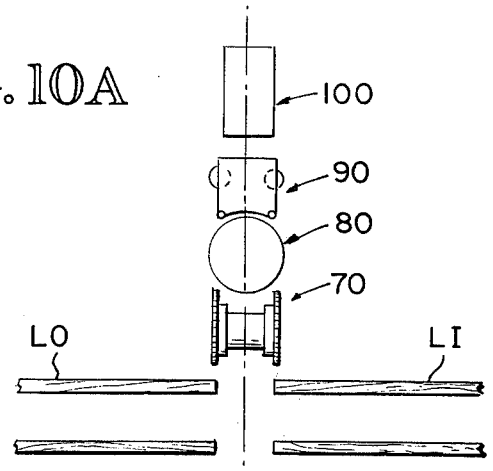
Figure 10B:
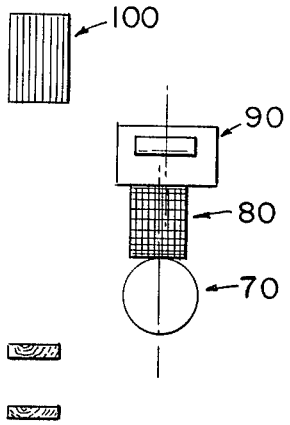
Figure 11:
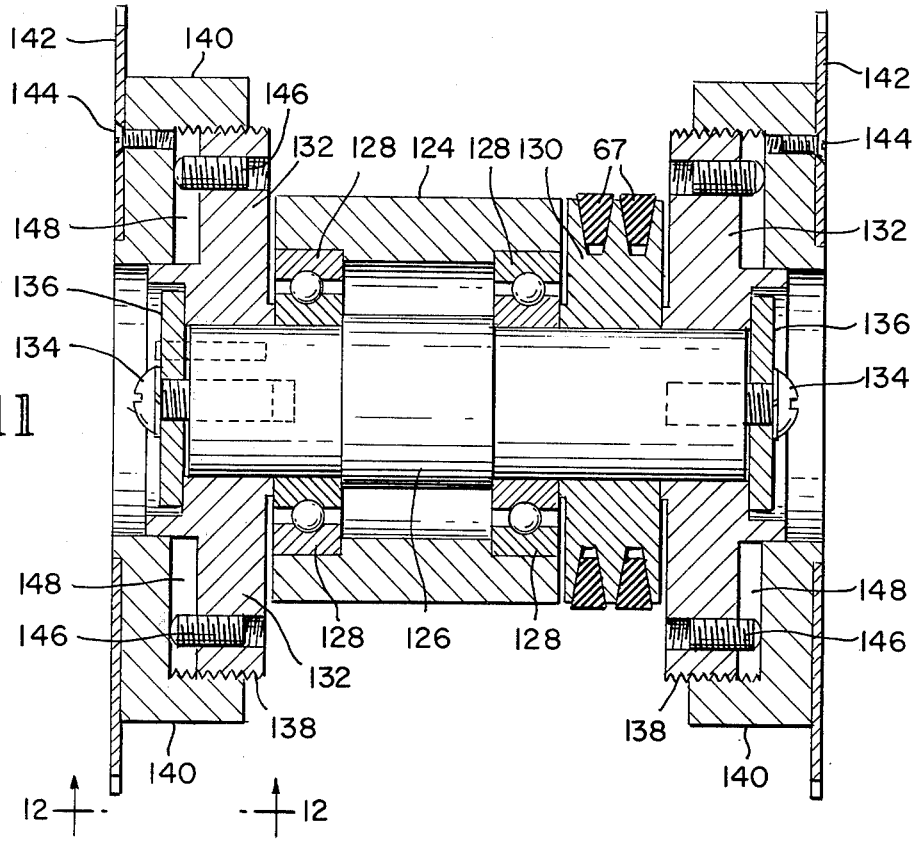
FIG. 11 is a cross-sectional view of details of the trim saw.
Figure 12:
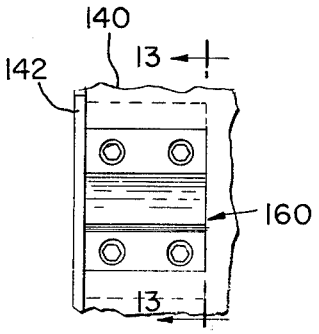
FIGS. 12 and 13 show partial detail views of the ripper teeth in the trim saws assembly.
Figure 13:
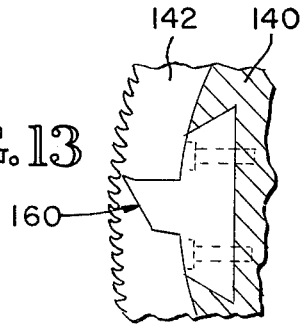

By reference to FIGS. 10A and 10B, it will be seen that the tail end of the board LO shown in FIG. 9A has advanced until its trailing end is in position approximately ⅛ inch within the cutting plane of the trim saw blades of saw 70. At the same time, the infeed conveyor has brought a new board LI into position and the vise cages again will clamp down and the cycle will begin anew.

The fingers of the boards after they have been cut by the shaper saw 80 have flats of approximately 0.018" to 0.020" at both the root and the crest and they have a length of approximately 0.256 inches. After being engaged and swedged by the hot die 100 the wood becomes densified or more densely formed by about 30%. As an illustration of this particular representation, the flats at both the root and the crest of the fingers are almost to a knife type edge or from about 0.002 to a 0.005 inch width dimension. The length of the teeth after the die operation is increased to about 0.380 inches. The heat in the die plasticizes and as mentioned above densifies the wood. The die also leaves residual heat in the fingers which assists in curing the glue. The nearly parallel grain fluing of the wood results in a good bonding surface and thus makes a stronger joint. The cycle time described above is less than fourteen seconds.

The trim saw structure described above makes adjustment of the same extremely easy and precise. The center line of the trim saw passes between the ends of the boards and inside the edge planes of the boards in contrast to the conventional way of having the centerline outside those limits. As a result of the design of the trim saw and the fact that the centerline passes between the ends of the board, as set forth above, the size of the blades is reduced, the mass of the trim saw assembly is reduced, which results in a shorter sash stroke, that is, the vertical slide movement which the trim saw must make is reduced.

The heater die is kept at a temperature range from about 460° F. to about 505° F. maximum. The optimum temperature is at about 485° F. for fast cycling but the precise temperature setting of the heater die will depend upon the moisture content of the wood. Scorching is to be avoided since it may cause delamination within a few years. The temperature can also be dropped if the wood is dry. The moisture content of wood processed for finger joints ranges from about 6% to 20% for dried lumber. The ideal range is from about 14% to 21% moisture content. As was described with respect to FIGS. 6A and 6B, after the shaper saw has made its pass but prior to the engagement of the fingers with the die, water is squirted on the ends of the boards if their moisture content is 14% or below. Pressing the teeth on the die requires about a two second period of time. The water, if it is used, is squirted on alternately for perhaps 3/10 of a second.

The glue pot or applicator 100 employs preferably a waterproof phenol resorcinol type adhesive. Also, of course, melamine urea glue can be employed. The glue is applied at approximately 212° to 350° F. temperature of the wood at the instant of its application to the teeth. The rollers of the glue pot or applicator reach as stated above approximately ½ the depth of the teeth. The glue pot in hot weather is cooled since its best temperature in the applicator pot is around 48° F.

It will be appreciated that if the boards were brought in at a perfect 90° angle to the longitudinal axis of the shaper saw that when the boards were jammed together the teeth ends would not clear each other. Accordingly, the conveyor line, including the vise cages 110, is approximately from perhaps less than one to two or three degrees off a perfect right angle so that when the boards are pressed together by the cages to form the joint, the teeth of one miss the teeth of the other and thus mesh without causing problems.

What is claimed is:

1. A method of end joining pieces of lumber with impression type finger joints, comprising:

(a) moving the ends of two pieces of lumber to a work station and clamping the same firmly in position a predetermined distance apart, (b) precisely trimming the ends of said lumber pieces by passing through said station trim saw means which is adjustable to a preselected position with respect to the longitudinal axis of and between the board ends for control of finger length so that the ends are prepared for forming, (c) substantially simultaneously preshaping the opposed board ends by passing a single axis preshaper saw means through said station between said board ends to form opposed and complimentary angled finger members of predetermined dimensions, (d) further shaping and forming said opposed angled finger members by moving teeth forming heated die means into said work station between said board ends and forcing said opposed board ends and angled finger members against said die teeth for a predetermined period of time to impression form said angled finger members by densifying and lengthening the same, and thereafter removing said heated die means from said work station, (e) substantially simultaneously applying adhesive material to said angled finger members of the opposed board ends by passing adhesive applying means between said board ends, and (f) jamming said opposed board ends and finger members together in interlocking relationship for a predetermined period of time to complete the forming of said impression type finger joint.

2. The method of end joining pieces of lumber according to claim 1, and in which the rotational axis of said trim saw means passes through the rectangular area defined by the board surfaces between the ends of said pieces of lumber.

3. The method of end joining pieces of lumber according to claim 1 and in which the longitudinal axis of the pieces of lumber extends at a predetermined slight angle off a right angle to the axis of the preshaper saw means.

4. The method of end joining pieces of lumber according to claim 3 and in which the lumber's longitudinal axis angle off said right angle is less than 2 degrees.

5. The method of end joining pieces of lumber according to claim 1 and in which said preshaper saw forms said fingers with flats at the roots between and on the ends of said fingers.

6. The method of and joining pieces of lumber according to claim 1 and in which said trim saw means, preshaper saw means, heated forming die means and adhesive applying means are passed generally vertically through said work station.

7. The method of end joining pieces of lumber according to claim 1 and in which said adhesive material is applied to said finger member on both pieces by applicator means to a depth of about one-half the length of said fingers.

8. The method of end joining pieces of lumber according to claim 1 and in which two or more lines of lumber and finger joints are processed in a single end joining operational cycle.

9. The method of end joining pieces of lumber according to claim 1 and in which water is sprayed on said preformed fingers in preselected and predetermined cases depending on the wood moisture content prior to their being engaged with said heated forming die means.

10. Apparatus for making impression type finger joined lumber, comprising:

(1) a support frame means having a front side and a rear side and including longitudinally aligned infeed and outfeed conveyor means spaced outwardly from said front side between which conveyor means is a work station, (2) a vertically reciprocally movable carrier frame means supported on said support frame and movable through a predetermined amount of vertical travel, (3) a horizontally movable secondary frame means supported on said carrier frame means for movement with said carrier frame, (4) trim saw means and shaper saw means supported on said horizontal secondary frame means such that said trim and shaper saw means can be moved horizontally outwardly to a first operative portion at said work station and retracted to a nonoperative second position, said trim and shaper saw means in the operative position passing vertically through said work station when said carrier frame is moved through said travel distance, (5) adhesive applying means supported on said secondary frame for independent horizontal movement such that it is movable between an outward operative position and a retracted inoperative position and when in the operative position, is disposed to pass through said work station when said carrier frame is moved through its travel distance, (6) heating and forming die means supported on said carrier frame means for movement into and out of said work station upon said predetermined amount of travel distance by said carrier frame means, and (7) power and actuating means for said frames, said saws, said adhesive applying means and for said die means.

11. The apparatus according to claim 10 and in which said movable carrier frame means is a generally rectangular frame which is open and wherein said movable secondary frame is supported generally on the rear side of said carrier frame.

12. The apparatus according to claim 11 and wherein the said trim saw means, shaper saw means and adhesive applying means in their inoperative position are retracted toward the rear side of said carrier frame so as to be spaced horizontally away from said work station.

13. The apparatus according to claim 12 and in which each of said infeed and outfeed conveyor means are provided with vise cage designed to clamp onto lumber pieces and to move toward and away from each other so as to move lumber ends into said work station.

14. The apparatus according to claim 13 and in which the longitudinal axis of said infeed and outfeed conveyors is set a predetermined angle off the parallel to said carrier frame.

15. The apparatus according to claim 10 and in which the drive means for said trim saw means, shaper saw means and adhesive applying means are also supported on said secondary frame means.

16. The apparatus according to claim 10 and in which said shaper saw means is comprised of essentially a series of stacked saw blade members having cutting edges of predetermined configuration.

17. The apparatus according to claim 10 and in which said trim saw means consists of two spaced apart blades on opposite ends of a single rotational axis and in which the rotation drive therefor is belt means extending from between the blades to motor means.

18. The apparatus according to claim 17 and in which said blades are precisely adjustable for setting the predetermined distance therebetween, said blades being detachably secured to an internally threaded mounting portion which in turn is threadably received on a blade spindle means.

19. The apparatus according to claim 18 and in which detachable locking means are provided in said spindle means for securing the blade adjustment in said blade mounting portion.

20. The apparatus according to claim 19 and in which detachable hogging teeth are provided on the periphery of said blade mounting means.

21. The apparatus according to claim 20 and in which said saw blades are received on said blade mounting means so as to leave the outside surfaces of said trim saw means flush and free of any projections.

* * * * *